US005086950A

United States Patent [19]

Crossdale et al.

[11] Patent Number: 5,086,950

[45] Date of Patent: Feb. 11, 1992

[54] LIQUID DISPENSING APPARATUS

[75] Inventors: Garry W. Crossdale, Deryshire; Paul A. Johnson, Chesterfield; Kenneth J. H. Bird, Nottingham, all of England

[73] Assignee: Diversey Corporation, Ontario, Canada

[21] Appl. No.: 435,808

[22] Filed: Nov. 13, 1989

[30] Foreign Application Priority Data

Nov. 14, 1988 [GB] United Kingdom ..... 8826627

[51] Int. Cl.[5] ..... B67D 5/00

[52] U.S. Cl. ..... 222/88; 222/185; 222/479

[58] Field of Search ..... 222/82, 83.5, 86, 185, 222/214, 105, 479, 651-652

[56] References Cited

U.S. PATENT DOCUMENTS

| | | | |
|---|---|---|---|
| 3,092,106 | 6/1963 | Butler | 222/88 X |
| 3,131,712 | 5/1964 | Risley et al. | 222/83 |
| 3,200,994 | 8/1965 | Levinson et al. | 222/82 |
| 3,542,240 | 11/1970 | Solowey | 222/83 |
| 3,685,694 | 8/1972 | Ianelli | 222/82 |
| 3,826,408 | 7/1974 | Berndt et al. | 222/651 |
| 3,953,902 | 5/1976 | Taylor | 222/86 X |
| 3,995,772 | 12/1976 | Liautaud | 222/83.5 |
| 4,173,295 | 11/1979 | Steinman | 222/185 X |
| 4,699,188 | 10/1987 | Baker et al. | 141/18 |
| 4,921,150 | 5/1990 | Lagergren et al. | 222/639 |
| 5,020,220 | 6/1991 | Miyake et al. | 222/83 |

FOREIGN PATENT DOCUMENTS

| | | | |
|---|---|---|---|
| 746231 | 11/1966 | Canada | 222/651 |
| 1031533 | 6/1958 | Fed. Rep. of Germany | 222/185 |

*Primary Examiner*—Michael S. Huppert
*Attorney, Agent, or Firm*—Weintraub, DuRoss & Brady

[57] ABSTRACT

An apparatus for dispensing liquid or slurried products, in particular detergents and rinse aids for industrial cleaning processes, typically but not exclusively dish-washing machines. Replaceable containers are fitted directly to a receptacle on the operative part of the machine and the liquid product is easily dispensed from the container into the machine without spillage or soil-age of user's hands. The apparatus is characterized by self-sealing around a hollow penetrating device that can be inserted when in use, at the lowermost portion.

6 Claims, 2 Drawing Sheets

LIQUID DISPENSING APPARATUS

FIELD OF THE INVENTION

The present invention relates to an apparatus for dispensing liquid or slurried products, in particular detergents, wetting agents, drying agents and rinse aids for industrial cleaning processes, typically but not exclusively dishwashing machines.

BACKGROUND OF THE INVENTION

Conventionally, liquid detergents are supplied to customers in large drums and the detergent reservoir in the dishwashing machine is regularly filled up from the drums. This is a laborious and inconvenient method of keeping the dishwashing machine topped up and could result in spillage of the liquid, which is often caustic, onto the operator's hands.

Alternatively, the detergent may be supplied from a relatively large drum and pumped into the dishwashing machine along a tube or otherwise dispensed directly into the dishwashing machine. Such pumping systems often cause spillage of the detergents when the operator is disconnecting and reconnecting the pumping system to the supply drum.

An aim of one aspect of the present invention is to provide a system whereby the liquid product can be supplied in relatively small containers which are fitted directly to the operative part of a machine, for example the dispenser of a dishwashing machine, thereby minimizing or eliminating spilling and leakage. An aim of a further aspect of the invention is to provide a system whereby the liquid product can be easily and cleanly dispensed along a tube again minimizing or eliminating spillage and soiling of the user's hands.

SUMMARY OF INVENTION

In accordance with an aspect of the invention an apparatus is provided for dispensing liquid or slurried products into an operational device comprising a container containing the product and means for withdrawing the product from the container, the means for withdrawing characterized by a reusable self-sealing septum into which a hollow penetrating device has been inserted the septum forming a seal around one end of the penetrating device such that the product is dispensed from the container through the penetrating device and into the operational device without leakage or spillage.

In accordance with another aspect of the invention an apparatus is provided for dispensing liquid or slurried products, further comprising a seat for the container wherein the container is removable therefrom and wherein the container has self-sealing means at a portion which, in use, is lowermost and wherein the penetrating means is attached to the seat.

In accordance with another aspect of the invention an apparatus is provided for dispensing liquid or slurried products, comprising a tube removably connected to the container, and means to urge the product along the tube, wherein the self-sealing means is at the end of the tube which connects to the container and wherein the penetrating device is attached to the container.

In accordance with a further aspect of the invention a container is provided which mounts directly on a seat connected to a dispensing device, comprising: a body portion; a head portion; and self-sealing means at the head portion which, in use, is lowermost; a cap which is attached over the head portion even when the container is mounted on the seat the cap having means through which said self-sealing means may be opened.

Other and further advantages and features of the invention will be apparent to those skilled in the art from the following detailed description thereof, taken in conjunction with the accompanying drawings.

BRIEF DESCRIPTION OF THE DRAWINGS

Preferred embodiments of the invention are described in detail below with reference to the accompanying drawings, wherein.

DETAILED DESCRIPTION OF PREFERRED EMBODIMENTS

In a first aspect of the present invention there is provided an apparatus for dispensing liquid products comprising a portable removable container of the liquid product, a seat or other suitable receptacle for the container, wherein the container has self-sealing means at a portion which, in use, is lowermost and wherein the seat has means to open the self-sealing means of the container.

In a second aspect of the invention there is provided an apparatus for dispensing liquid products comprising a container for the liquid product, a tube removably connected to the container and means to urge the product along the tube, wherein the tube has self-sealing means at its end connecting to the container and wherein the container has means to open the self-sealing means of the tube.

Preferably, the self-sealing means is in the form of a septum which can be opened by a penetrating device mounted on the seat or container. Advantageously, the container comprises means to allow ingress of air as the liquid product is dispensed. It is appreciated that the fit between the mounted container and the seat will permit some air to circulate between the container and the seat.

The first aspect of the invention offers substantial advantages over the prior art as smaller containers can be used which can easily be fitted onto a dispenser without spillage. Further, the containers can be removed without any leakage. The second aspect of the invention also offers substantial advantages as the tube can be easily and clearly connected to and disconnected from the container without spillage or soiling of the user's hands.

It should be noted that in the system of the invention the septum is in the removable container or tube and the penetrating device is on the fixed dispenser or container, in contrast to, for example, the medical industry where a bag of fluid having a rubber septum is held in a static position and is pierced by a moving hollow penetrating device. While liquid products comprise a preferred embodiment of the invention, one skilled in the art would appreciate that other products, slurries for example, could also be worked in this invention.

Figure 1:
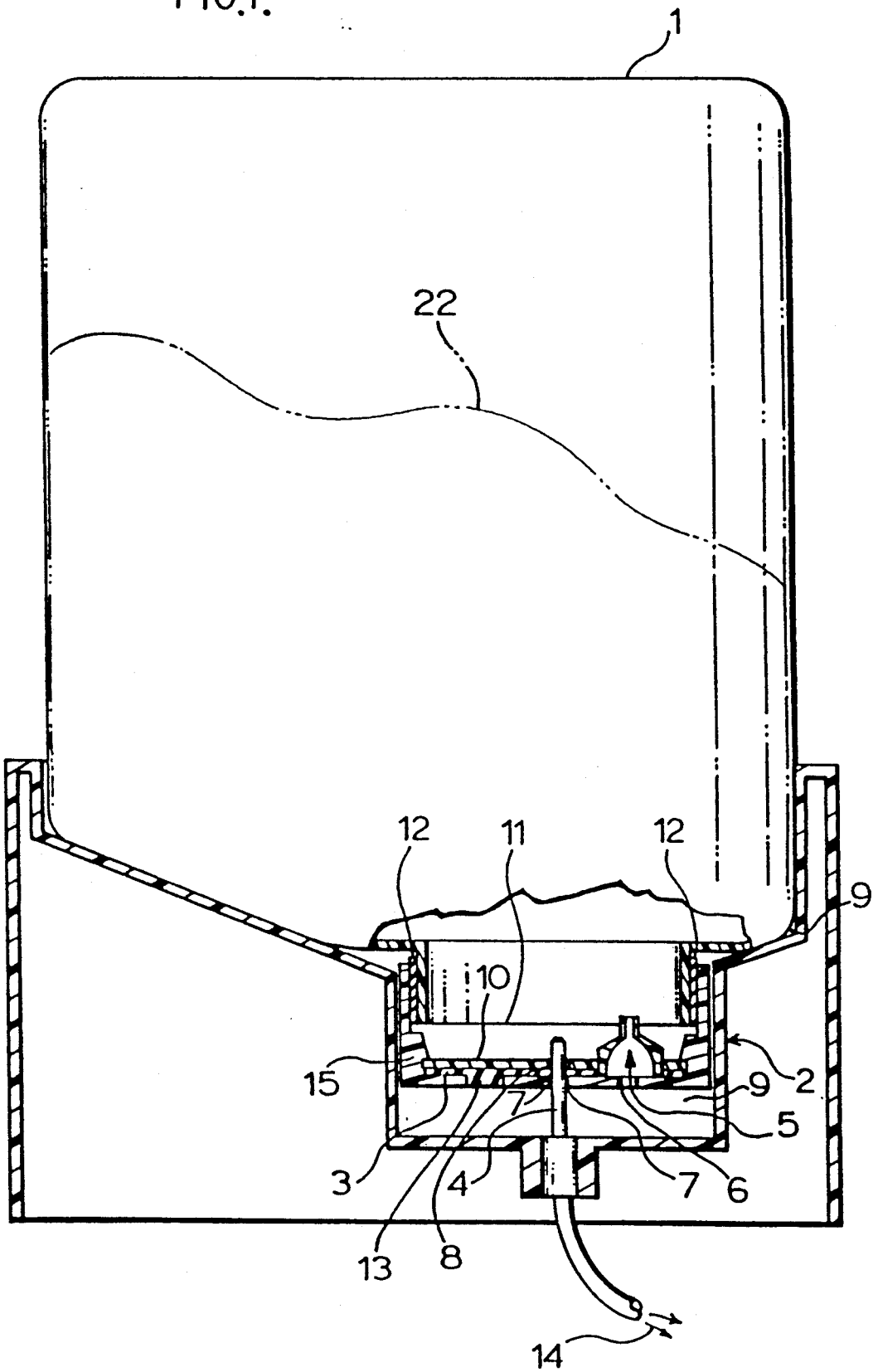
FIG. 1 is a vertical section through a dispensing apparatus according to the first aspect of the invention.

The apparatus illustrated in FIG. 1 for dispensing liquid products comprises a removable container 1 for a suitable product and seat or receptacle generally designated 2 for the container.

When the container 1 is in use it is inverted. The container 1 has a head portion which, in use, rests on portions of and occupies portions of the seat 2. The mouth 11 of the container 1 is covered by a cap 15 which, in this embodiment, is attached to the container by means of threads 12. The container has an elastomer septum 3 and a blunt liner 10 The seat 2 has a hollow penetrating device 4 or spigot fitted therein which, when the container 1 is mounted on the seat 2, passes through a slit on the septum 3 and an aperture in the liner 10 to allow liquid to be dispensed.

The septum 3 is provided with a self-sealing lip or mitral valve 5 which allows air 9 to enter the container 1 via aperture 6 as the product escapes. As an alternative, the container could be provided with an internal liner 22 which collapses as the liquid is dispensed at 14.

The septum 3 consists of a rubber elastomer material which has a slit in it (slit not shown). The slit is self-sealing and prevents liquid from escaping unless the sides of the slit are forced apart, for example by the penetrating device 4. Once the penetrating device 4 has been inserted in the slit the sides of the slit form a seal around the penetrating device to prevent leakage while the product is dispensed.

The cap 15 is attached over the head of the container even when the container is mounted on the seat 2. The cap 15 advantageously guides the head of the container 1 into position in the seat 2 and facilitates the loading and unloading of the container onto the dispenser without spillage Such guiding of the cap provides for alignment of the penetrating device 4 with the slit in the septum. The septum 3 is fitted into the cap 15. The cap has a small aperture 7 coinciding with the split of the septum 3. Similarly the liner 10 has an aperture 8 coinciding with the split of the septum 3. It is appreciated that the liner 10 may be of a diaphragm or membrane material which is punctured by the device 4. A similar aperture 6 is provided over the lip valve 5. In this embodiment the septum 3 is fixed to the cap 6 at position 13.

The seat 2 may be part of a wall-mounted dispensing device and the container 1 can be loaded and unloaded onto the dispenser easily, without any of the product accidentally being spilt.

It should be noted that the individual container can be considered as an invention in its own right.

Figure 2:
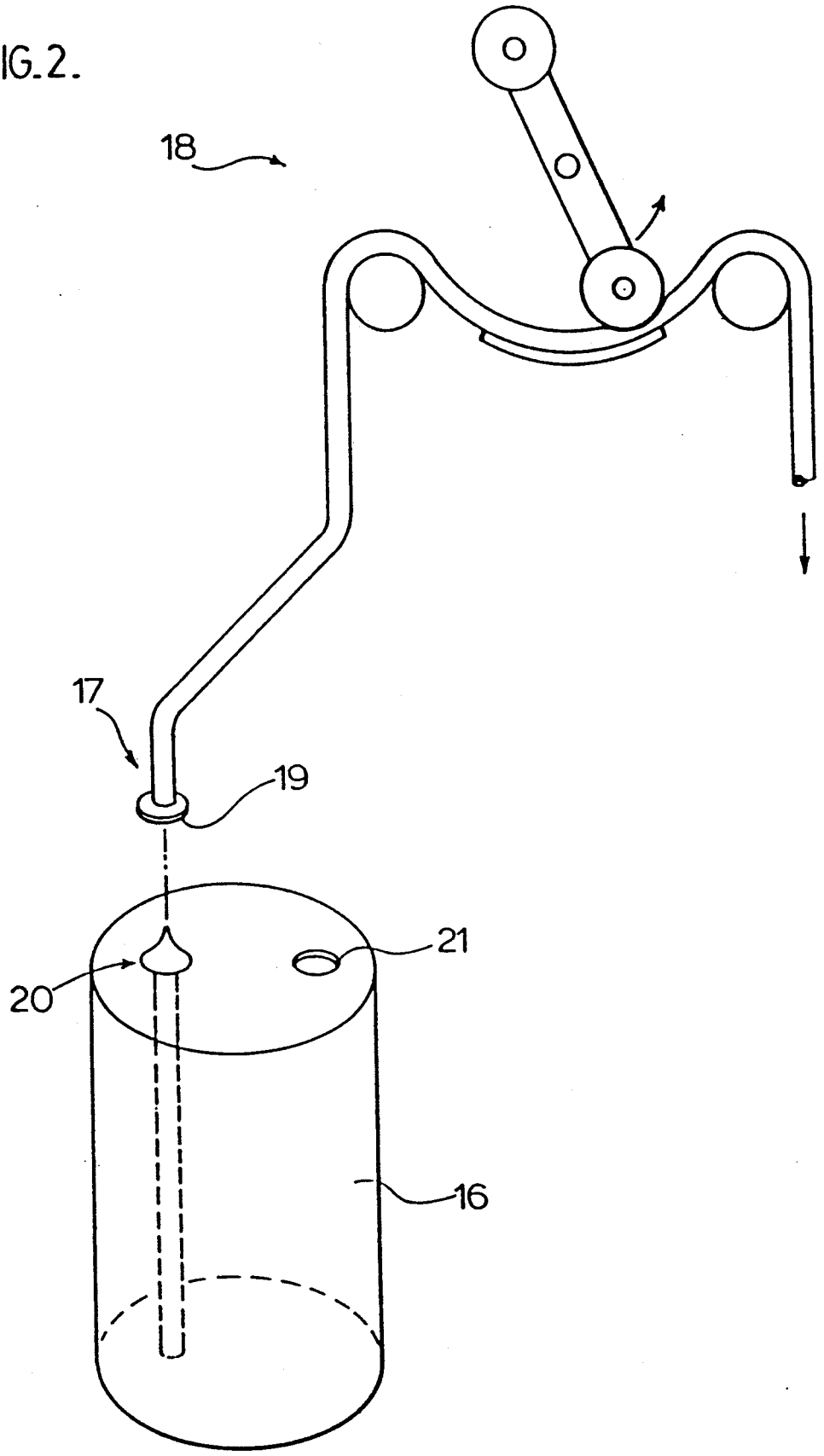
FIG. 2 is a schematic view of a dispensing system according to a second aspect of the invention.

The system illustrated in FIG. 2 comprises an alternative embodiment for a container 16 for the liquid product. A tube 17 is removably connected to the container 16 and means 18 urges the product along the tube 17. The means 18 here consists of a peristaltic pump which "massages" the tube 17.

The tube 17 has a rubber septum 19, with a slit therein, and a penetrating device 20 is provided in the container. When the tube 17 is connected to the container 16, the penetrating device 20 passes through the septum 19 to allow the liquid to be pumped to the dishwashing machine (not shown).

The container 16 comprises a vent 21 to allow air in as the liquid is pumped out. Alternatively, a collapsible liner could be provided.

Although preferred embodiments of the invention have been described herein in detail, it will be understood by those skilled in the art that variations may be made thereto without departing from the spirit of the invention or the scope of the appended claims.

What I claim is:

1. An apparatus for dispensing liquid or slurried products comprising:

(a) a container for a liquid or slurried product said container having an outlet which is covered by a self sealing septum said septum having slits therein;

(b) a receptacle for receiving said container with the said septum lowermost, said receptacle having a blunt hollow penetrating device for forcing part said slit, the septum around said slit sealing around said penetrating device to prevent leakage;

(c) means connected to said penetrating device for dispensing liquid or slurried products from said container;

(d) said container having means for allowing ingress air as produce is dispensed from the container; and (e) wherein the slit eliminates the need for piercing the septum with said hollow penetrating device and said septum is self sealing before penetration and after the penetrating device is removed.

2. An apparatus of claim 1 wherein said septum is made of a rubber elastomer material.

3. An apparatus of claim 1 wherein said container has a collapsible liner for containing said product.

4. An apparatus of claim 1 wherein said penetrating device is a spigot mounted on said receptacle.

5. An apparatus of claim 1 wherein said receptacle is part of a wall-mounted dispensing device.

6. An apparatus of claim 1 wherein said container has a cap covering the septum, the cap having an aperture formed therein in-line with the slit of the septum, and further wherein said cap aligns the penetrating device with the slit in the septum.

* * * * *

UNITED STATES PATENT AND TRADEMARK OFFICE

CERTIFICATE OF CORRECTION

PATENT NO. : 5,086,950

DATED : February 11, 1992

INVENTOR(S) : Garry W. Crossdale, et. al.

It is certified that error appears in the above-identified patent and that said Letters Patent is hereby corrected as shown below:

Column 4, line 32, delete "produce" and substitute --product--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*